United States Patent [19]

Miknaitis et al.

[11] 4,240,054

[45] Dec. 16, 1980

[54] ARRANGEMENT FOR LOCKING A REED CAPSULE WITHIN A MAGNETIC LATCHING REED SWITCH ASSEMBLY

[75] Inventors: Sigitas Miknaitis, Clarendon Hills; Charles J. Stastny, La Grange Park, both of Ill.

[73] Assignee: GTE Automatic Electric Laboratories Incorporated, Northlake, Ill.

[21] Appl. No.: 12,627

[22] Filed: Feb. 16, 1979

[51] Int. Cl.[3] ..... H01H 1/66; H01H 51/00

[52] U.S. Cl. ..... 335/152; 335/202

[58] Field of Search ..... 335/112, 151, 152, 202

[56] References Cited

U.S. PATENT DOCUMENTS

| | | | |
|---|---|---|---|
| 3,678,423 | 7/1972 | Rovnyak | 335/152 X |
| 3,783,421 | 1/1974 | Miknaitis | 335/152 |
| 3,940,722 | 2/1976 | Fox et al. | 335/151 |

*Primary Examiner*—Fred L. Braun

*Attorney, Agent, or Firm*—Robert J. Black; Anthony Miologos

[57] ABSTRACT

An arrangement for locking a reed capsule within a tubular bobbin of a reed switch assembly comprising, a deflectable tab located adjacent a slot formed by two upstanding arms. The tab is disposed to deflect inward when a wire return strap connected to a reed capsule is inserted into the slot. When the reed capsule is fully seated within the bobbin the tab returns outward over the wire strap, locking the strap between the tab and the closed end of the slot.

6 Claims, 2 Drawing Figures

ARRANGEMENT FOR LOCKING A REED CAPSULE WITHIN A MAGNETIC LATCHING REED SWITCH ASSEMBLY

BACKGROUND OF THE INVENTION

1. Field of the Invention

The present invention relates generally to the field of electromagnetic switches and more particularly to a new and improved arrangement for locking a reed capsule within a magnetic latching reed switch assembly.

2. Description of the Prior Art

In modern telephone systems the reed switch has found wide acceptance as a crosspoint in switching matrices. One recently developed form of this type of switch is disclosed in U.S. Pat. No. 3,783,421, granted Jan. 1, 1974, to Sigitas Miknaitis. The reed capsules are housed in an axially extending internal compartment in a bobbin which has a base forming flange at one end. A plurality of coil terminals and associated pins are disposed about the base for entering into contact with apertures arranged in a corresponding pattern on a wiring card.

A distinct feature of the above mentioned switch was the method used for locking the reed capsules within the bobbin. The upper end of the bobbin is provided with slots which are adapted to receive the transverse portion of an L-shaped return strap. The return strap is attached by welding the transverse portion to the upper reed capsule lead and inserting it within the slots, it is finally locked into position by a means of a under cut tab found adjacent to the slot.

Initially, the switches were designed with 0.022 diameter nickel silver wire return straps. The original wire had sufficient ductility to enter into the under cut tab without much destruction of the molded plastic corner or damage to the capsule seals. Accordingly, sufficient retention forces were provided to hold capsules in the bobbin.

To satisfy field performance requirements it was necessary to institute a change to magnetic return straps of 0.026 diameter steel wire. To accommodate the heavier return straps the bobbin crown was modified according to the original under cut tab method. Experiments with bobbins molded to accept the heavy return straps, even after several attempted changes, were unsatisfactory. Numerous tests indicated the existance of two adverse conditions. Assemblies with sufficient retention forces required excessive insertion forces to snap into the under cut. These assemblies contained a large percentage of capsules with cracked seals. Conversely, assemblies with acceptable insertion forces produced many capsules that became unlatched during handling and electrical inspection. The main difficulty was traced to relatively stiff steel return straps that deformed most of the plastic corner intended to retain the capsule in the device.

To achieve the best balance between low insertion force and high retention the flexible tab concept was introduced.

Accordingly, it is the object of the present invention to provide a new and improved arrangement for locking a reed capsule within a magnetic latching reed switch assembly.

SUMMARY OF THE INVENTION

In accomplishing the object of the present invention, there is provided as the environment, a magnetic latching reed switch assembly of the type to which the invention is applied. The reed switch assembly is comprised of a vertically oriented tubular bobbin including a base portion with at least one reed capsule disposed within the bobbin. A first reed capsule lead extends downward through the base portion and a second lead upward from the bobbin. An L-shaped return strap has a transverse section connected to the second lead and a longitudinal section extending downward along the exterior of the bobbin and passing through the base portion. It should be noted that the reed switch includes other functional elements and a more detailed description may be found in U.S. Pat. No. 3,783,421, issued on Jan. 1, 1974, to Sigitas Miknaitis and having a common assignee.

The reed capsule locking arrangement in accordance with the present invention, includes a bobbin crown formed from at least one pair of upstanding members disposed about the periphery of the bobbin. The arms are of a configuration such that they form a slot along respective edges. The slot leads from a generally broad open mouth to a narrow closed termination end at the bobbin. An inwardly flexible finger is disposed along an edge of one of the arms adjacent the slot, forming a flexible under cut tab.

The reed capsule is locked into the assembly by inserting the reed capsule within the bobbin with the transverse section of the return strap arranged obliquely to the bobbin crown. A first portion of the transverse section of the return strap follows one edge of one of the members simultaneously as a second portion is placed within the slot. As the capsule is inserted the second portion deflects the finger inward allowing the strap to reach the under cut tab at the closed termination end of the slot. When the capsule is finally seated the finger returns to its normal position, which at this time overlays the strap, locking the reed capsule to the bobbin.

The present invention alleviates damage to the capsule seals during the assembly process and eliminates unlatching of the capsule from the bobbin. By flexing back, with minimal damage to the locking corner, the flexible tab locks and retains the return strap and reed capsule in the magnetic latching reed switch assembly with far better reliability then previous configuration.

BRIEF DESCRIPTION OF THE DRAWINGS

A better understanding of the invention may be had from a consideration of the following detailed description taken in conjunction with the accompanying drawings in which.

PREFERRED EMBODIMENT OF THE INVENTION

Figure 1:
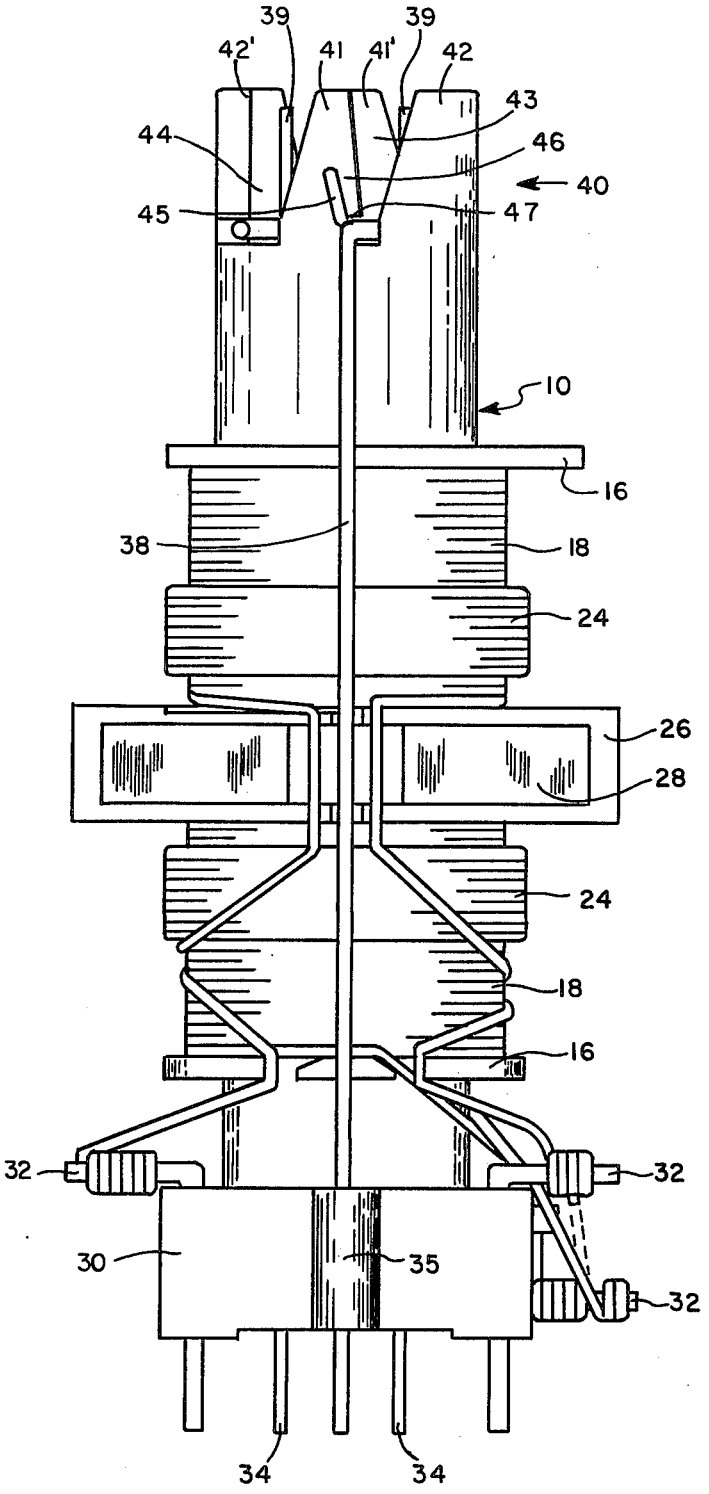
FIG. 1 is a front elevational view of a magnetic latching reed switch assembly including the arrangement for locking the reed capsule in accordance with the present invention described herein.
Figure 2:
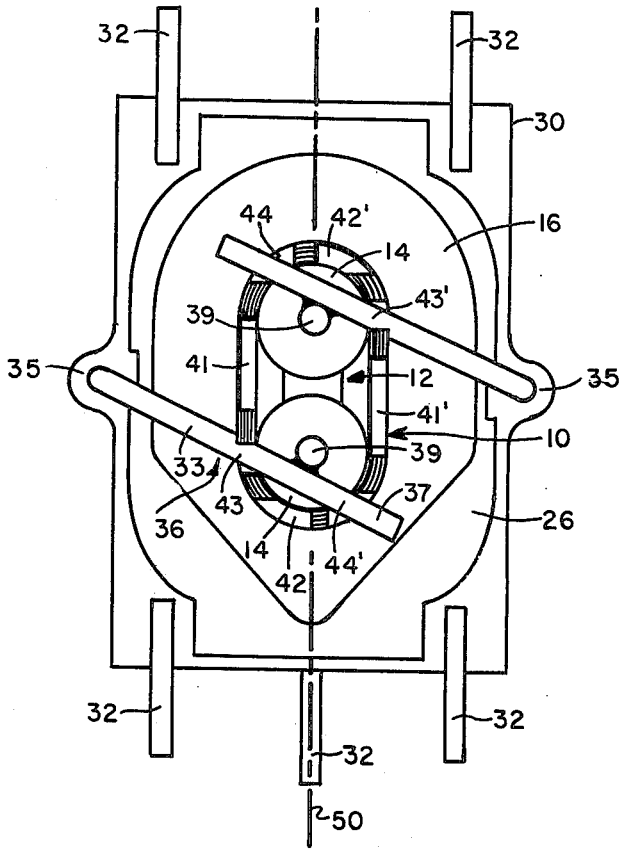
FIG. 2 is a top planar view, of the magnetic latching reed switch assembly of FIG. 1.

Referring now to the accompanying drawings of the present invention FIG. 1 and FIG. 2 illustrates a magnetic latching reed switch assembly as would be used for switching the tip and ring paths of a telephone switching system and of the type to which the invention is applied. While a switch having two reed capsules is shown for the purposes of illustration it will be understood that the present invention contemplates both single capsule and multiple capsule embodiments as well.

The main component of the illustrated switch from a manufacturing point of view is the bobbin 10 which is typically molded from a suitable dielectric thermoplastic material. The bobbin 10 is generally elliptical in cross section and has a longitudinal channel 12 adapted to receive reed capsules 14. Bobbin 10 is further provided with integrally formed spacers 16 for control coils 18 and 24. A molded flange 26 is adapted to receive and retain a magnetic shunt element 28. The bottom end of the bobbin 10 is provided with a base 30 in which a plurality of terminals 32 are inserted for terminating the leads from the control coils. The bottom leads 34 from reed capsules 14 extend through apertures and beyond the lower extremity of the base 30. L-shaped return straps 38 are attached to the upper leads 39 of the reed capsules 14 and extend downwardly along the outside of the bobbin 10 passing through receiving members 35. It should be noted that the foregoing description of the magnetic latching read switch assembly is considered the functional environment and forms no part of the claimed invention.

As shown on FIG. 1 and FIG. 2 the present invention contemplates the use of a bobbin crown 40, including a first pair of arms 41, 41' and a second pair of arms 42, 42'. The arms are integrally molded to the bobbin 10 and are located along the outer circumference of channel 12. Each pair of arms is configured as to define four slots, which include locking slots 43, 43' and guiding slots 44, 44'. Each locking slot is linearly aligned to a respective guiding slot and arranged obliquely to a bobbin horizontal center line 50. Each of the slots begin at a relatively broad open mouth and terminate at a narrow closed termination end. One edge of each arm 41 and 41' corresponding to respective locking slots 43, 43' includes a deflectable finger 46, 46'. As can be seen best on FIG. 1 finger 46 is formed from a diagonally oriented opening 45 and includes a bottom portion cut away forming a tab 47 overlaying a portion of the locking slots 43 closed termination end. The distance between the tab 47 and the locking slot edge of arm 42 is less than the locking slot 43 closed termination end.

The reed capsule 14 and locking strap 38 assembly is installed and locked in the bobbin in the following manner. The reed capsule 14 is inserted within the channel and the longitudinal section of return strap 38 is inserted within an orifice on receiving member 35. The transverse section of locking strap 38 shown generally as 36 is separated by the reed capsule lead 39 into two portions. The first portion 37 is inserted within a respective guiding slot and the second portion 33 within a respective locking slot. As the transverse section 36 of strap 38 is displaced downward along with the reed capsule, portion 33 deflects finger 46 inward allowing portion 33 to reach the locking slot closed end. When fully seated within the closed termination end the finger deflects back to its permanent position and overlays portion 33. The distance between the slot closed termination end and the tab equals the diamater of the wire strap. Thus, when fully seated, transverse section 36 of the return strap rests obliquely within the bobbin crown and is locked between tab 47 and locking slot 43 closed termination end securing the associated reed capsule within the bobbin.

The present invention has been described with reference to a specific embodiment thereof, for the purpose of illustrating the manner in which the invention may be used to advantage, it will be appreciated by those skilled in the art that the invention is not limited thereto. Accordingly any and all modifications variations or equivalent arrangements which may occur to those skilled in the art should be considered to be within the scope of the invention.

What is claimed is:

1. Reed capsule locking means, for a magnetic latching reed switch, said reed switch including a bobbin having a base portion, a longitudinal channel therein, a reed capsule switching element disposed in said longitudinal channel having a first electrical lead extending through said base portion and a second electrical lead extending upward from said bobbin, a return strap including a transverse section connected to said second electrical lead and a longitudinal section extending downward adjacent to the exterior of said bobbin, said locking means comprising:

a bobbin crown including at least first and second upstanding arms disposed about the periphery of said channel and forming a slot therebetween including a closed termination on one end; and a deflectable member formed from a portion of said first upstanding arm adjacent to said slot and adapted to deflect inward when said return strap transverse section is inserted into said slot and returned outward when said strap is fully seated in said slot termination end, locking said reed capsule switching element to said bobbin.

2. Reed capsule locking means as recited in claim 1, wherein: said bobbin crown is molded to said bobbin as a unitary structure and said first arm includes an opening diagonally oriented and having a closed end away from said bobbin and an open end adjacent to said bobbin defining a first section integrally molded to said bobbin and a second section forming said deflectable member.

3. Reed capsule locking means as recited in claim 1, wherein: there is further included at least one additional reed capsule switching element and return strap and said bobbin crown includes third and fourth upstanding arms disposed about the periphery of said channel and forming a slot therebetween including a closed termination on one end, said third arm includng a deflectable member formed from a portion of said upstanding third arm adjacent to said slot and adapted to deflect inward when said additional return strap transverse section is inserted into said slot and returned outward when said strap is fully seated in said slot termination end, locking said additional reed capsule switching element to said bobbin.

4. Reed capsule locking means are recited in claim 1, wherein: said bobbin includes an end opposite said base and said bobbin crown is longitudinally positioned on said bobbin end.

5. Reed capsule locking means are recited in claim 1, wherein: said slot further includes a second end, said second end arranged as a broad open mouth and said slot longitudinally tapers from said open mouth to said closed termination.

6. Reed capsule locking means as recited in claim 1, wherein: said return strap is an L-shaped unitary structure formed from steel wire.

* * * * *